US006805537B2

(12) United States Patent
Wu

(10) Patent No.: US 6,805,537 B2
(45) Date of Patent: Oct. 19, 2004

(54) PUMP WITH DETACHABLE PRESSURE GAUGE

(76) Inventor: Scott Wu, No. 6, Lane 176, Wu Fu Road, Wu Feng Hsiang, Taichung Hsien (TW)

( * ) Notice: Subject to any disclaimer, the term of this patent is extended or adjusted under 35 U.S.C. 154(b) by 0 days.

(21) Appl. No.: 10/187,869

(22) Filed: Jul. 1, 2002

(65) Prior Publication Data

US 2004/0001761 A1 Jan. 1, 2004

(30) Foreign Application Priority Data

Nov. 6, 2002 (TW) ..... 91112852 A

(51) Int. Cl.[7] ..... F04B 33/00
(52) U.S. Cl. ..... 417/63; 73/756; 417/440
(58) Field of Search ..... 73/756; 417/63, 417/440

(56) References Cited

U.S. PATENT DOCUMENTS 938,522 A * 11/1909 Swain ..... 417/63
1,649,530 A * 11/1927 Holsinger ..... 417/63
1,867,779 A * 7/1932 Thompson ..... 73/756
4,901,761 A * 2/1990 Taylor ..... 73/756
5,902,097 A * 5/1999 Wu ..... 417/440

* cited by examiner

*Primary Examiner*—Michael Koczo
(74) *Attorney, Agent, or Firm*—Alan D. Kamrath; Nikolai & Mersereau, P.A.

(57) ABSTRACT

A pump includes a cylinder, a piston, a rod, a handle, a nozzle and a pressure gauge. The piston is received in a space extending through the cylinder. To pump, the piston is reciprocated in the cylinder. The rod is connected with the piston so that the piston is moved via operating the rod. The handle is connected with the rod for facilitating the operation of the rod. The nozzle is in communication with the cylinder. A pressure gauge can be engaged with and disengaged from the nozzle. A flow control unit is in communication with the nozzle for detachable engagement with the pressure gauge. The flow control unit provides an open position when engaged with the pressure gauge and a closed position when disengaged from the pressure gauge.

20 Claims, 7 Drawing Sheets

16
12
10'
11
14
222
212
221
21
214
31
23
32
20
42
24
211
22
17
18
13
30
0
5
10
15
20
50
100
150
200
250
300

PUMP WITH DETACHABLE PRESSURE GAUGE

BACKGROUND OF INVENTION

1. Field of Invention

The present invention relates to a pump with a detachable pressure gauge.

2. Related Prior Art

Cycling is a very popular activity for traveling and/or exercising. Many riders like to carry pumps with them for use in case of emergency. Some of the pumps for bicycles are equipped with pressure gauges. These conventional pressure gauges are secured to the pumps, i.e., they cannot be detached from the pumps. Compared with the pumps, the conventional pressure gauges are bulky and cause inconvenience in operation of the pumps. Therefore, riders using pumps equipped with pressure gauges often wish that they had pumps without pressure gauges. Many riders simply choose not to have pumps equipped with pressure gauges although they know that sometimes pressure gauges are needed for precise pumping.

The present invention is therefore intended to obviate or at least alleviate the problems encountered in prior art.

SUMMARY OF INVENTION

It is the primary objective of the present invention to provide a pump with a detachable pressure gauge.

According to the present invention, a pump includes a cylinder, a piston, a rod, a handle, a nozzle and a pressure gauge. The piston is received in a space extending through the cylinder. To pump, the piston is reciprocated in the cylinder. The rod is connected with the piston so that the piston is moved via operating the rod. The handle is connected with the rod for facilitating the operation of the rod. The nozzle is in communication with the cylinder. A pressure gauge can be engaged with and disengaged from the nozzle.

A flow control unit is in communication with the nozzle for detachable engagement with the pressure gauge. The flow control unit provides an open position when engaged with the pressure gauge and a closed position when disengaged from the pressure gauge.

The flow control unit includes a housing, a body, a spring and a cap. The housing is received in a space defined in the nozzle. The housing through which a channel extends includes an annular ridge formed on an internal face thereof. The body is received and can be moved in the channel. The body includes an annular flange formed thereon for abutment against a side of the annular edge. The spring is mounted on the body, and the cap is mounted on the body so that the spring is compressed between the cap and an opposite side of the annular edge. Thus, the spring tends to drive the annular flange into abutment against the annular edge.

The flow control unit includes an annular seal mounted on the body so as to improve sealing between the annular flange and the annular edge.

The pressure gauge includes a tube for disengaging the annular flange from the annular edge by pressing the cap. The tube defines a channel for communication with the channel defined in the housing, thus flowing air from the nozzle to the pressure gauge.

The pump includes a retaining device for retaining the tube in engagement with the flow control unit.

In a first aspect, the retaining device includes an annular rim formed on the nozzle and a ring mounted on the tube for engagement with the annular rim.

The pressure gauge may include an annular seal mounted on the tube so as to improve sealing between the tube and the annular rim.

In a second aspect, the annular rim includes two flanges formed on an external face, and the ring includes two hooks formed on an internal face for engagement with the flanges of the annular rim.

In a third aspect, the retaining device includes a ring mounted on the housing for engagement with the tube.

The pressure gauge includes an annular seal attached to an end of one of the housing and the tube.

Other objectives and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF EMBODIMENTS

Figure 1:
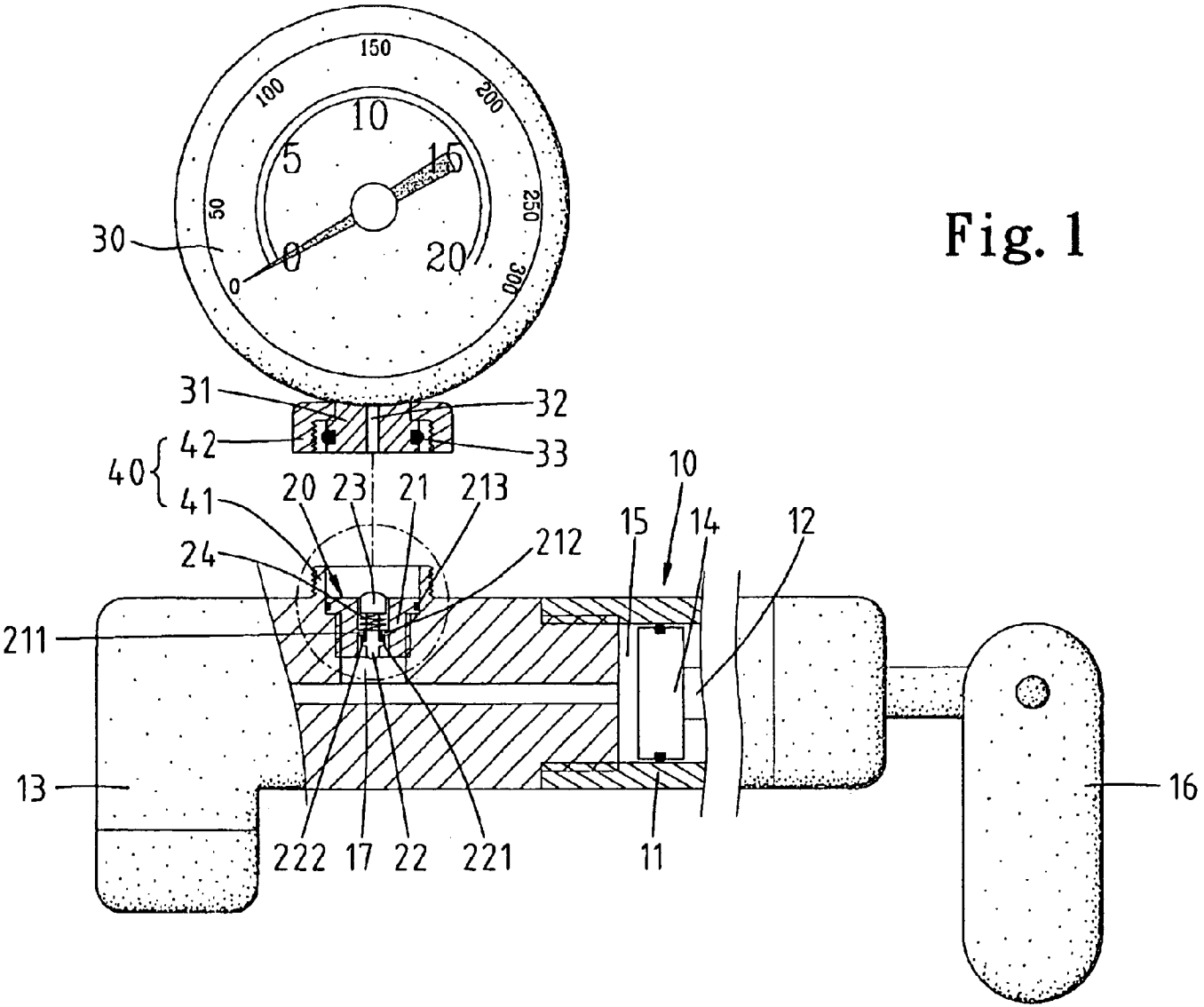
FIG. 1 is a partially cross-sectional view of a pump with a detachable pressure gauge according to a first embodiment of the present invention.

In FIGS. 1–5, according to the present invention, a pump 10 includes a cylinder 11, a piston 14, a rod 12, a handle 16, a nozzle 13 and a pressure gauge 30. The piston 14 is received in a space 15 extending through the cylinder 11. To pump, the piston 14 is reciprocated in the cylinder 11. The rod 12 is connected with the piston 14 so that the piston 14 is moved via operating the rod 12. The handle 16 is connected with the rod 12 for facilitating the operation of the rod 12. The nozzle 13 is in communication with the cylinder 11. A pressure gauge 30 can be engaged with and disengaged from the nozzle 13.

Interconnection of the cylinder 11, the piston 14, the rod 12, the handle 16 and the nozzle 13 will not be described in detail as being conventional.

Although shown adapted for detachable engagement with the nozzle 13, the pressure gauge 30 can be adapted for detachable engagement with the cylinder 11.

The pump 10 includes a flow control unit 20 in communication with the nozzle 13 for detachable engagement with the pressure gauge 30. The flow control unit 20 provides an open position when engaged with the pressure gauge 30 and a closed position when disengaged from the pressure gauge 30.

Figure 2:
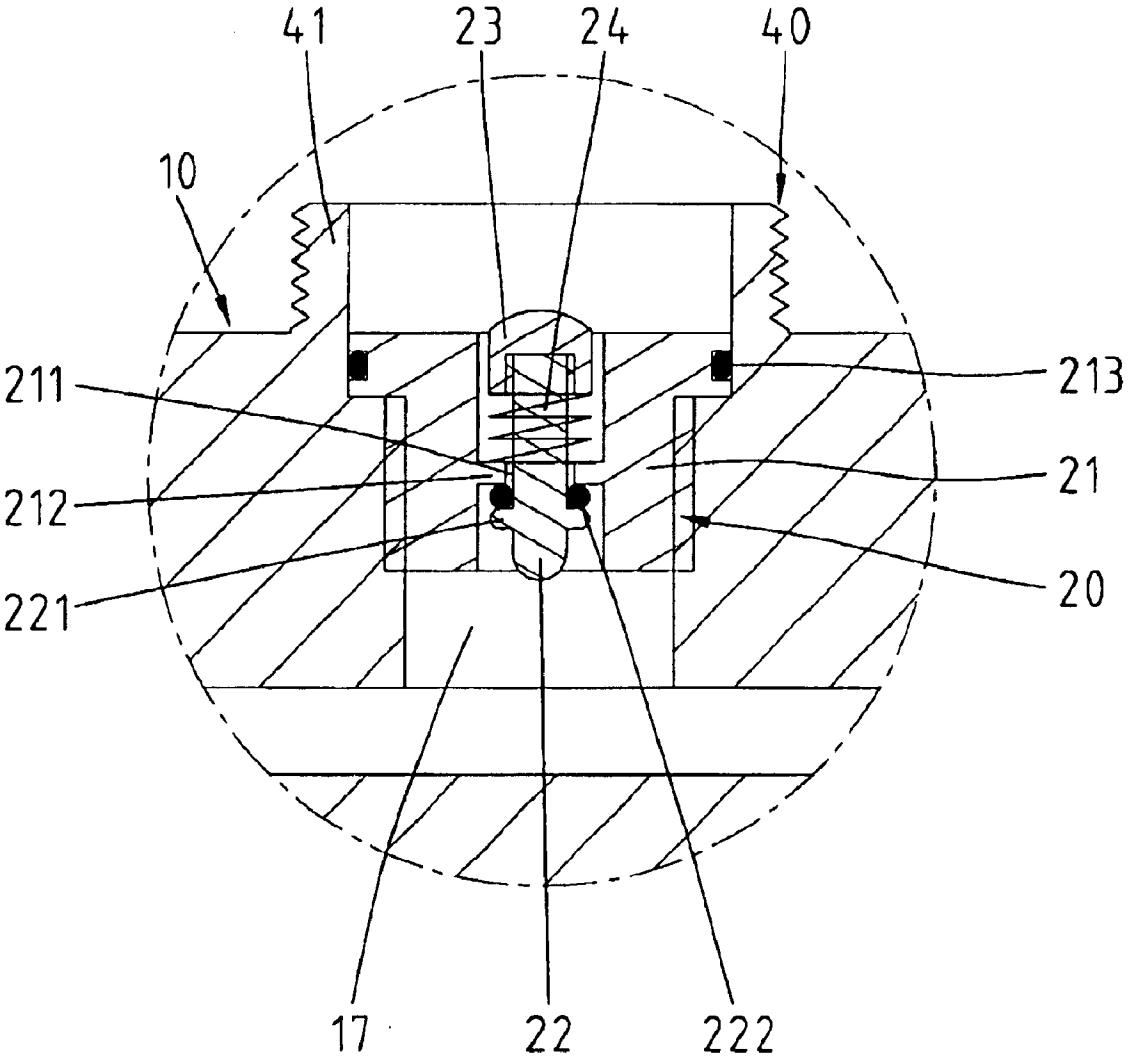
FIG. 2 is an enlarged cross-sectional view of a portion of the pump according to the first embodiment of the present invention.

As best seen in FIG. 2, the flow control unit 20 includes a housing 21, a body 22, a spring 24 and a cap 23. The housing 21 is received in a space 17 defined in the nozzle 13. The housing 21 through which a channel 211 extends includes an annular ridge 212 formed on an internal face thereof. The body 22 is received and can be moved in the channel 211. The body 22 includes an annular flange 221 formed thereon for abutment against a side of the annular ridge 212. The spring 24 is mounted on the body 22, and the cap 23 is mounted on the body 22 so that the spring 24 is compressed between the cap 23 and an opposite side of the annular ridge 212. Thus, the spring 24 tends to drive the annular flange 221 into abutment against the annular ridge 212.

A wall of the space 17 is threaded. The housing 21 includes a thread (not numbered) formed on an external face thereof. The thread formed on the housing 21 is brought into engagement with the thread formed on the wall of the space 17, thus retaining the housing 21 in the space 17.

The body 22 includes a thread (not numbered) formed thereon. The cap 23 includes a thread (not numbered) formed on an external face thereof. The thread formed on the cap 23 is engaged with the thread formed on the body 22, thus retaining the cap 23 on the body 22.

The flow control unit 20 includes an annular seal 222 mounted on the body 22 so as to improve sealing between the annular flange 221 and the annular ridge 212. The flow control unit 20 includes an annular seal 213 mounted on the housing 21 so as to improve sealing between the housing 21 and space 17.

The pressure gauge 30 includes a tube 31 for disengaging the annular flange 221 from the annular ridge 212 by pressing the cap 23. The tube 31 defines a channel 32 for communication with the channel 211 defined in the housing 21, thus flowing air from the nozzle 13 to the pressure gauge 30.

The pump 10 includes a retaining device 40 for retaining the tube 31 in engagement with the flow control unit 20.

Figure 3:
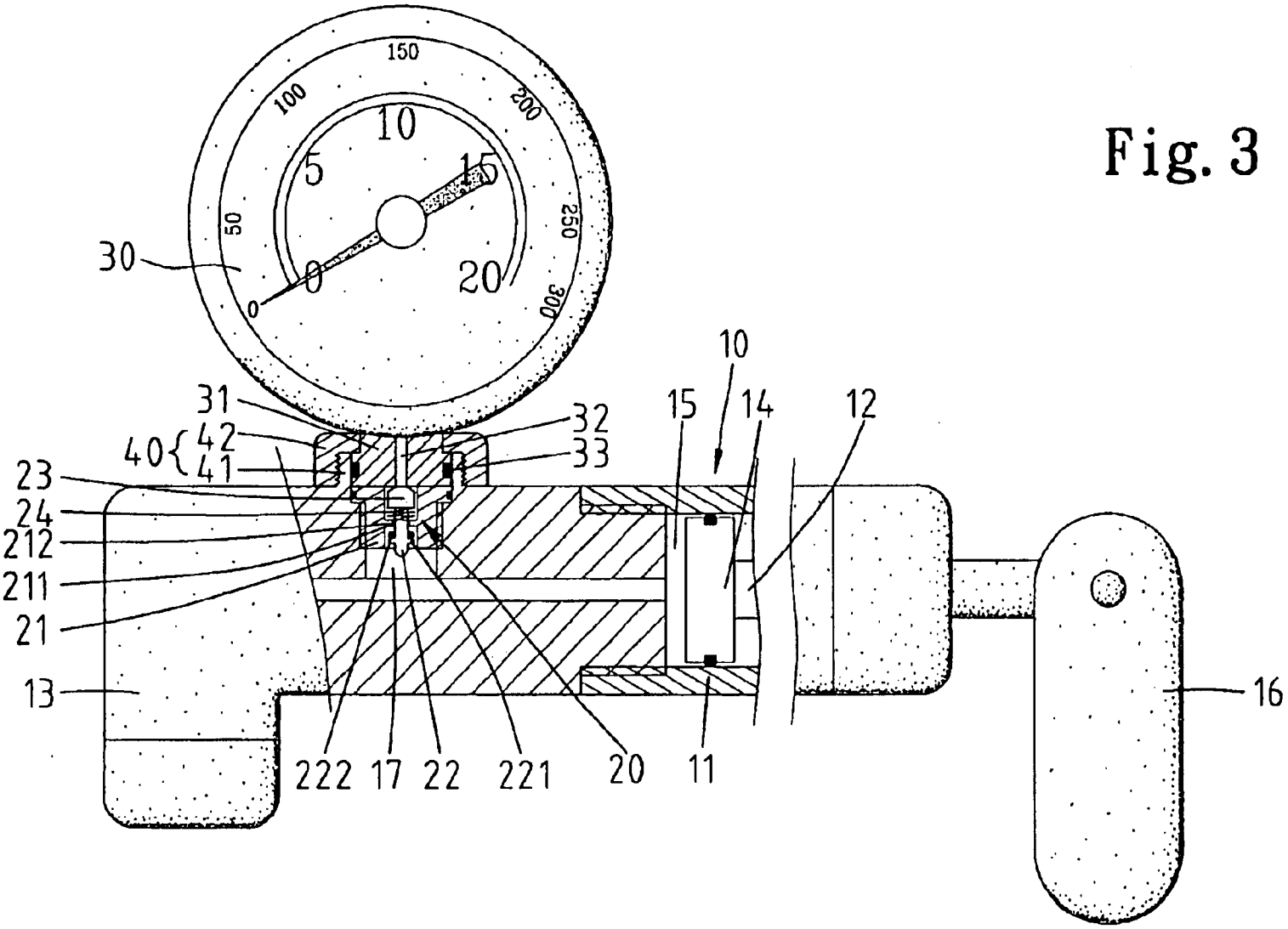
FIG. 3 is similar to FIG. 1 except for showing the pressure gauge mounted on the pump according to the first embodiment of the present invention.

Referring to FIGS. 1–3, according to a first embodiment of the present invention, the retaining device 40 includes an annular rim 41 formed on the nozzle 13 and a ring 42 mounted on the tube 31 for engagement with the annular rim 41.

The annular rim 41 is formed around the space 17 so that a space (not numbered) defined through the former is in communication with the latter. The tube 31 is inserted in the space defined through the annular rim 41.

The annular rim 41 includes a threaded external face. The ring 42 includes a threaded internal face. The threaded internal face of the ring 42 can be engaged with the threaded external face of the annular rim 41, thus retaining the pressure gauge 30 on the cylindrical joint.

The pressure gauge 30 may include an annular seal 33 mounted on the tube 31 so as to improve sealing between the tube 31 and the annular rim 41.

Figures 4, 5:
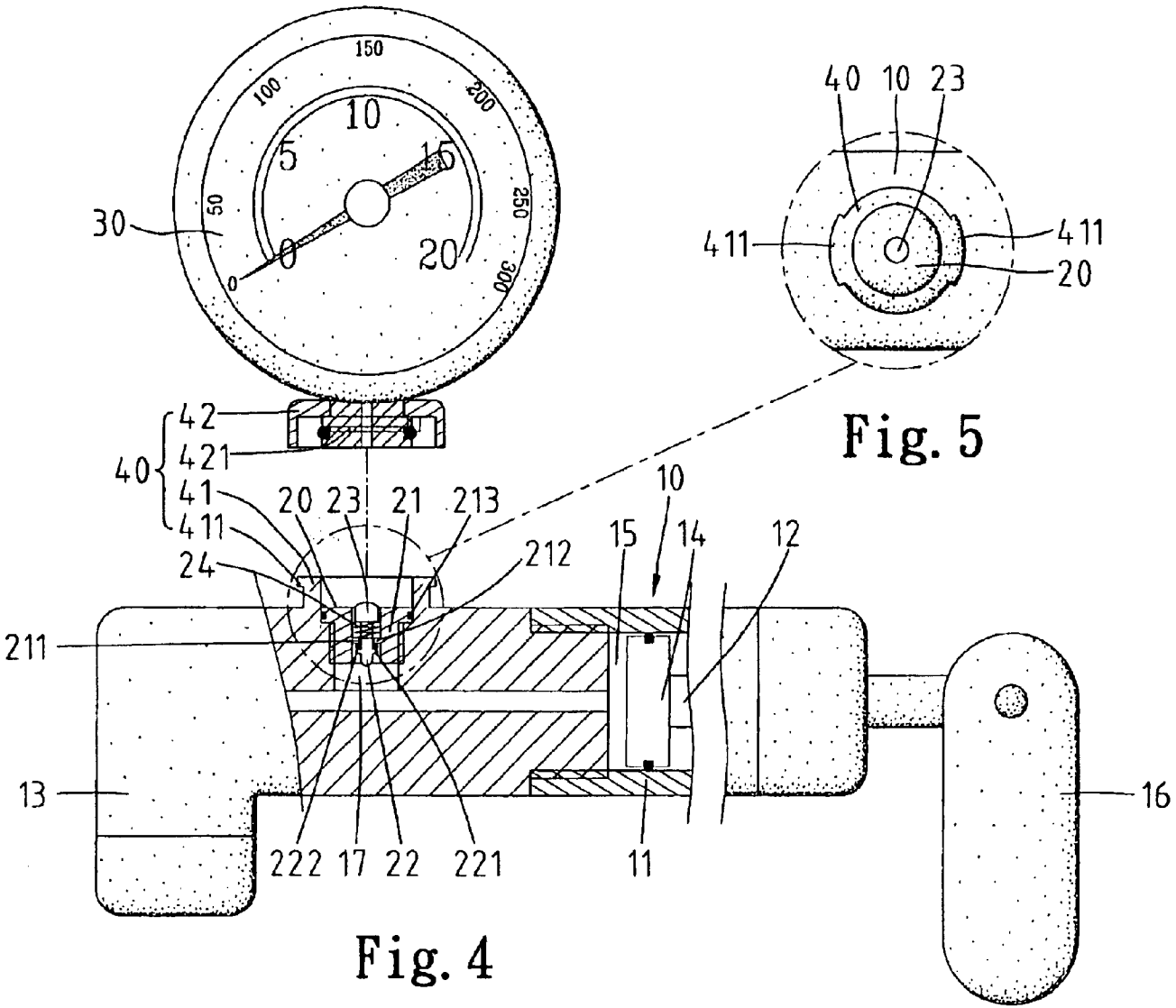
FIG. 4 is a partially cross-sectional view of a pump with a detachable pressure gauge according to a second embodiment of the present invention.
FIG. 5 is an enlarged top view of a portion of the pump according to the second embodiment of the present invention.
Figure 6:
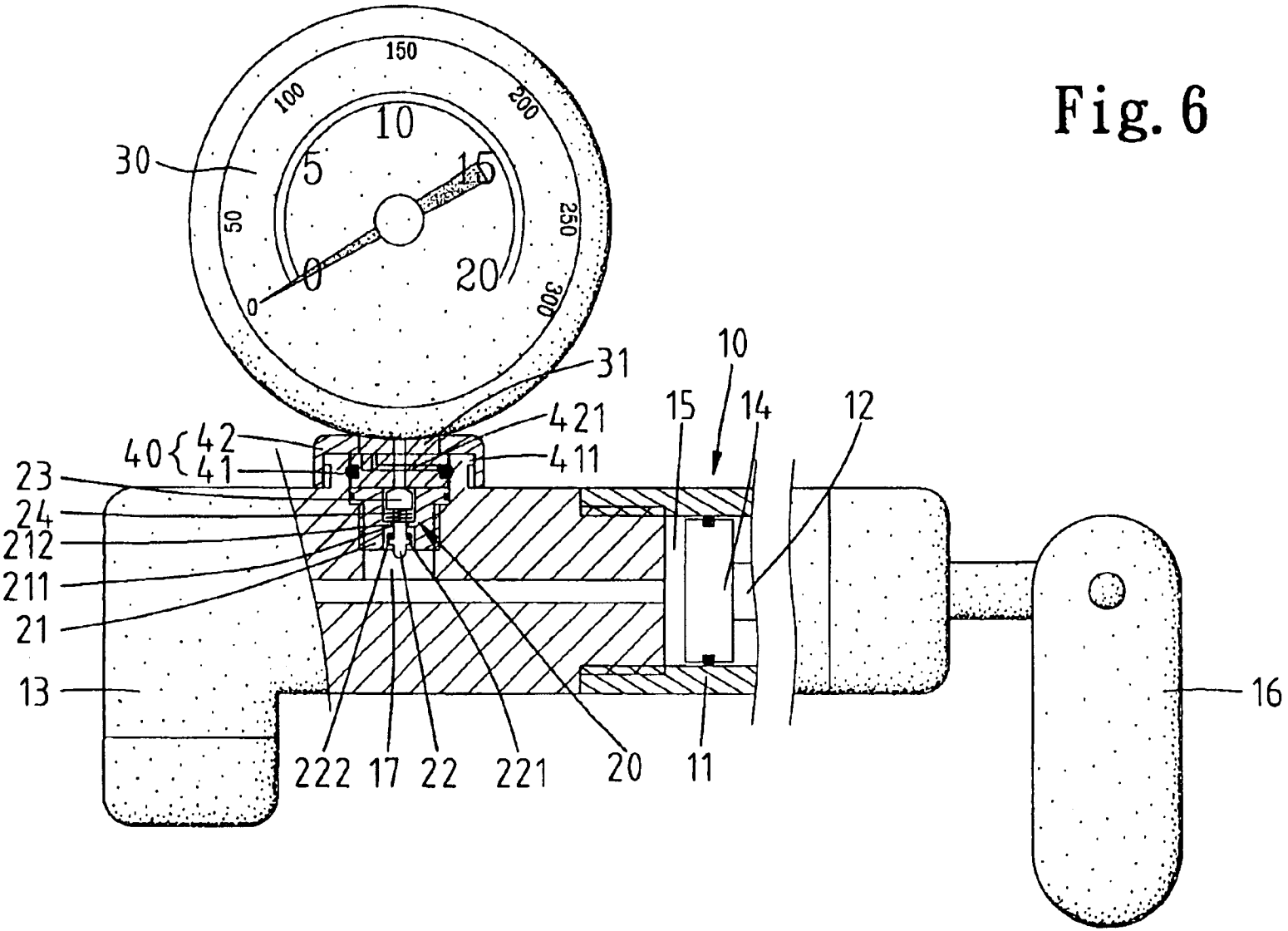
FIG. 6 is similar to FIG. 4 except for showing the pressure gauge mounted on the pump according to the second embodiment of the present invention.

Referring to FIGS. 4 and 5, according to a second embodiment of the present invention, the annular rim 41 includes two flanges 411 formed on an external face, and the ring 42 includes two hooks 421 formed on an internal face for engagement with the flanges 411 of the annular rim 41.

Figure 7:
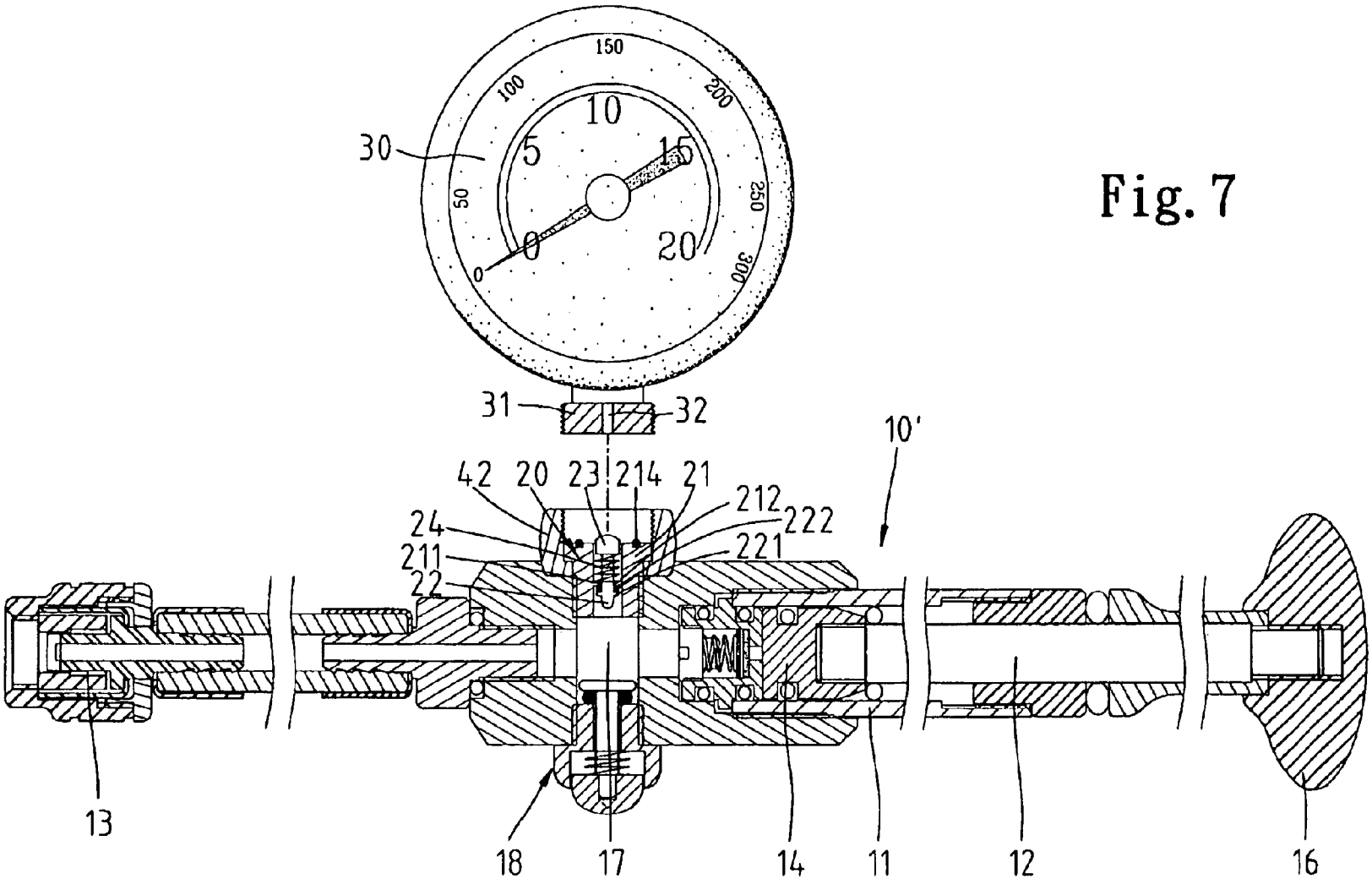
FIG. 7 is a partially cross-sectional view of a pump with a detachable pressure gauge according to a third embodiment of the present invention.
Figure 8:
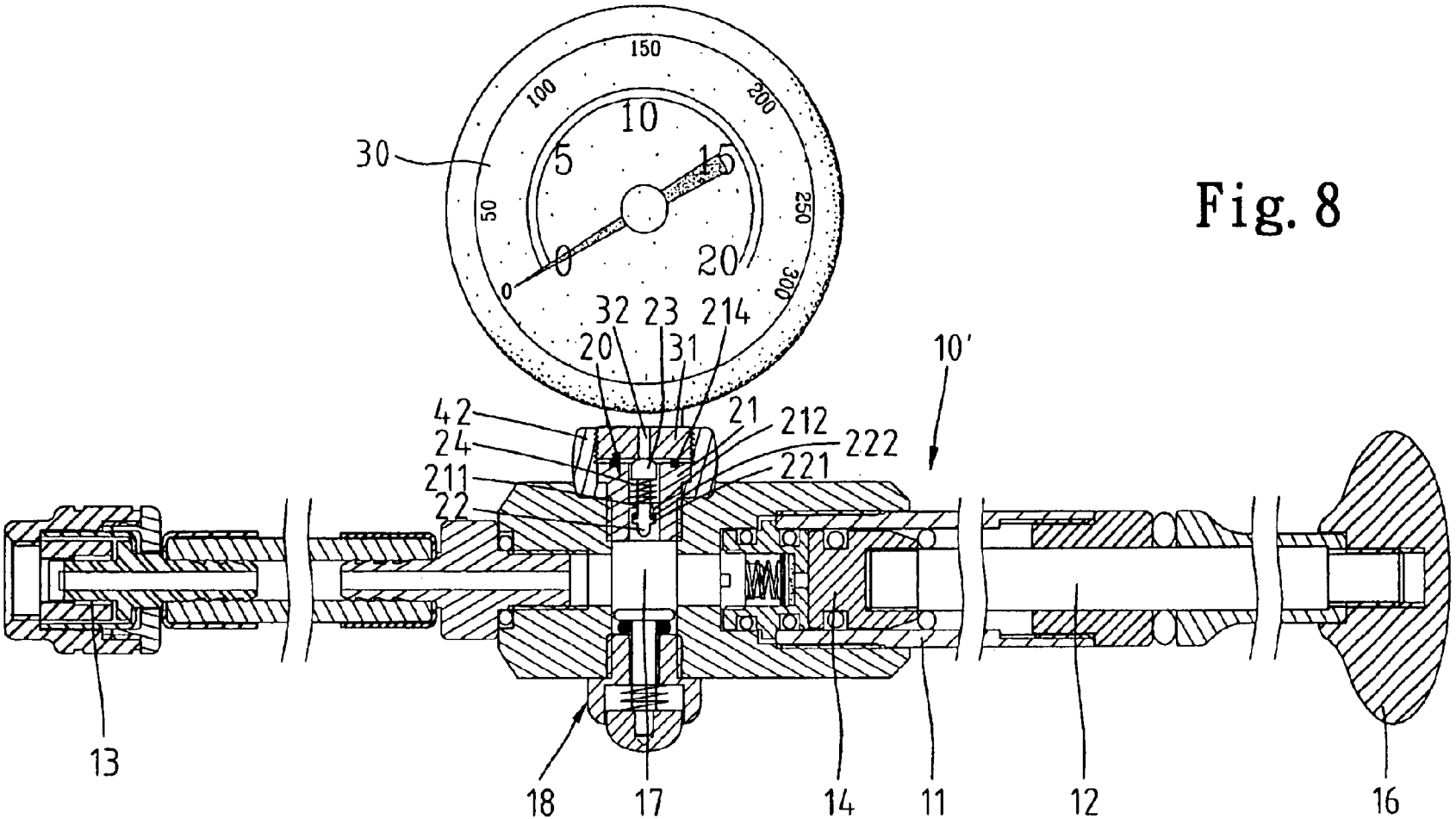
FIG. 8 is similar to FIG. 7 except for showing the pressure gauge mounted on the pump according to the third embodiment of the present invention.

FIGS. 7 and 8 show a pump 10' according to a third embodiment of the present invention. The pump 10' includes a cylindrical joint (not numbered) via which the cylinder 11 and the nozzle 13 are in communication. A draining device 18 is installed on the cylindrical joint for avoiding over pressurization of an article by the pump 10'. The draining device 18 will not be described in detail for being conventional.

The retaining device 40 includes a ring 42 mounted on the housing 21 for engagement with the tube 31.

The tube 31 includes a threaded external face, and the ring 42 includes a threaded internal face for engagement with the threaded external face of the tube 31.

The pressure gauge 30 includes an annular seal 214 attached to an end of one of the housing 21 and the tube 31.

The present invention has been described through detailed illustration of the preferred embodiment. Those skilled in the art can derive many variations from the preferred embodiment without departing from the scope of the present invention. Therefore, the preferred embodiment shall not limit the scope of the present invention. The scope of the present invention is defined in the attached claims.

What is claimed is:

1. A pump including a cylinder, a piston movably received in the cylinder, a rod linked to the piston, a nozzle in communication with the cylinder, a flow control unit in communication with the cylinder and the nozzle, and a pressure gauge for engagement with the flow control unit, the flow control unit providing an open position when engaged with the pressure gauge and a closed position when removed from the pressure gauge, with the flow control unit including an internal face defining a channel, with the flow control unit further including a body movably received in the channel, with the flow control unit further including an annular seal mounted on the body for abutment against the channel, with the flow control unit further including a spring mounted on the body, with the spring compressed between the body and the channel on an opposite side of the annular seal than a side of the annular seal abutting the channel and thus tending to drive the annular seal into abutment against the channel, with the body being driven to disengageably abut the annular seal with the channel.

2. The pump according to claim 1 wherein the flow control unit is connected with the nozzle.

3. The pump according to claim 1 including a draining device in communication with the cylinder and the nozzle.

4. The pump according to claim 1 with an annular ridge formed on the internal face, with the body including an annular flange formed thereon for abutment against the side of the annular ridge, with the annular seal mounted between the annular flange and the annular ridge.

5. The pump according to claim 4 wherein the flow control unit is connected with the nozzle.

6. The pump according to claim 4 with the flow control unit further including a cap mounted on the body with the spring compressed between the cap and the opposite side of the annular ridge.

7. The pump according to claim 6 with the pressure gauge formed with a tube for disengaging the annular seal from the annular ridge by pressing the cap.

8. The pump according to claim 4 with the flow control unit further including a housing having the channel defined therein, with the housing received in a space in communication with the cylinder and the nozzle.

9. A pump including a cylinder, a piston movably received in the cylinder, a rod linked to the piston, a nozzle in communication with the cylinder, a flow control unit in communication with the cylinder and the nozzle, and a pressure gauge for engagement with the flow control unit, the flow control unit providing an open position when engaged with the pressure gauge and a closed position when removed from the pressure gauge, wherein the flow control unit includes:

a housing including a channel defined therein and an annular ridge formed on an internal face, the housing being received in a space in communication with the cylinder and the nozzle;

a body including an annular flange formed thereon for abutment against a side of the annular ridge, the body being movably received in the channel;

a spring mounted on the body; and a cap mounted on the body so that the spring is compressed between the cap and an opposite side of the annular ridge, thus tending to drive the annular flange into abutment against the annular ridge.

10. The pump according to claim 9 wherein the flow control unit includes an annular seal mounted on the body between the annular flange and the annular ridge.

11. The pump according to claim 9 wherein the pressure gauge is formed with a tube for disengaging the annular flange from the annular ridge by pressing the cap.

12. The pump according to claim 11 wherein the tube defines a channel for communication with the channel defined in the housing.

13. The pump according to claim 11 including a retaining device for retaining the tube in engagement with the flow control unit.

14. The pump according to claim 13 wherein the retaining device includes an annular rim for receiving the tube and a ring mounted on the tube for engagement with the annular rim.

15. The pump according to claim 14 wherein the annular rim includes a threaded external face, and the ring includes a threaded internal face for engagement with the threaded external face of the annular rim.

16. The pump according to claim 11 wherein the pressure gauge includes an annular seal mounted on the tube.

17. The pump according to claim 13 wherein the annular rim includes two flanges formed on an external face, and the ring includes two hooks formed on an internal face for engagement with the flanges of the annular rim.

18. The pump according to claim 13 wherein the retaining device includes a ring mounted on the housing for engagement with the tube.

19. The pump according to claim 18 wherein the tube includes a threaded external face, and the ring includes a threaded internal face for engagement with the threaded external face of the tube.

20. The pump according to claim 18 wherein the pressure gauge includes an annular seal attached to an end of one of the housing and the tube.

* * * * *